US008824914B2

(12) United States Patent
Jeong et al.

(10) Patent No.: US 8,824,914 B2
(45) Date of Patent: Sep. 2, 2014

(54) SAFETY SYSTEM FOR IMAGE FORMING APPARATUS HAVING EXPENDABLE DEVELOPING UNIT

(75) Inventors: Gi Cheol Jeong, Suwon-si (KR); Byeong Hwa Ahn, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 252 days.

(21) Appl. No.: 13/315,460

(22) Filed: Dec. 9, 2011

(65) Prior Publication Data

US 2012/0148298 A1 Jun. 14, 2012

(30) Foreign Application Priority Data

Dec. 10, 2010 (KR) ..... 10-2010-0125944

(51) Int. Cl.
*G03G 15/00* (2006.01)
*G03G 15/08* (2006.01)
*G03G 15/18* (2006.01)

(52) U.S. Cl.
USPC ..... 399/90; 399/110; 399/111; 399/119

(58) Field of Classification Search
CPC ..... G03G 2221/169; G03G 2221/1654; G03G 2221/1684
USPC ..... 399/90, 110, 111, 119
See application file for complete search history.

(56) References Cited

U.S. PATENT DOCUMENTS 6,735,406 B1 * 5/2004 Noda ..... 399/111
8,213,828 B2 * 7/2012 Murayama et al. ..... 399/111
2007/0160384 A1 * 7/2007 Sakurai et al. ..... 399/110
2007/0160385 A1 * 7/2007 Noguchi et al. ..... 399/110
2007/0160386 A1 * 7/2007 Kawamura ..... 399/110
2007/0160388 A1 * 7/2007 Yoshimura et al. ..... 399/111
2008/0159772 A1 7/2008 Koishi et al.
2008/0159773 A1 * 7/2008 Murayama et al. ..... 399/90
2008/0159775 A1 7/2008 Koishi et al.
2008/0279579 A1 * 11/2008 Kuruma ..... 399/90
2008/0292355 A1 * 11/2008 Sakurai et al. ..... 399/110
2009/0047039 A1 * 2/2009 Noguchi et al. ..... 399/116
2009/0110434 A1 * 4/2009 Kusudo et al. ..... 399/109
2009/0129812 A1 * 5/2009 Kawanami et al. ..... 399/111
2010/0046980 A1 * 2/2010 Imaizumi et al. ..... 399/90
2010/0080617 A1 * 4/2010 Noguchi ..... 399/112

(Continued)

OTHER PUBLICATIONS

EPO search report in application 11192087.2-2216 dated Mar. 29, 2012.*

(Continued)

*Primary Examiner* — David Bolduc
(74) *Attorney, Agent, or Firm* — Stanzione & Kim, LLP

(57) ABSTRACT

An image forming apparatus includes a main body, a developing unit, a drawer movably installed at the main body and including a tray and a cover. The cover includes a first operation section and a second operation section, an interlocking member to be moved along with the drawer in the first operation section of the cover, and a lift member to be vertically moved according to movement of the interlocking member, wherein the developing unit is provided with a first connection terminal. The lift member is arranged with a second connection terminal, and the tray is arranged with a third connection terminal connected to the second connection terminal according to the position of the second connection terminal so that the second and third connection terminals are disconnected prior to extraction of the tray from the main body.

24 Claims, 12 Drawing Sheets

(56) References Cited

U.S. PATENT DOCUMENTS

| | | | | |
|---|---|---|---|---|
| 2010/0158563 | A1* | 6/2010 | Tanabe et al. | 399/111 |
| 2010/0209139 | A1* | 8/2010 | Sakurai et al. | 399/111 |
| 2010/0239314 | A1* | 9/2010 | Takayama | 399/112 |
| 2010/0247138 | A1* | 9/2010 | Kikuchi et al. | 399/110 |
| 2011/0052254 | A1* | 3/2011 | Hashimoto | 399/110 |
| 2011/0116832 | A1* | 5/2011 | Koishi et al. | 399/111 |
| 2011/0123223 | A1* | 5/2011 | Koishi et al. | 399/111 |
| 2011/0206412 | A1* | 8/2011 | Tanabe et al. | 399/111 |
| 2011/0262181 | A1* | 10/2011 | Noguchi | 399/110 |
| 2011/0299883 | A1* | 12/2011 | Suzuki | 399/110 |
| 2012/0114374 | A1* | 5/2012 | Suzuki | 399/111 |
| 2012/0195627 | A1* | 8/2012 | Kikuchi | 399/110 |

OTHER PUBLICATIONS

EPO search report in application 11192087.2-2216 dtd Mar. 29, 2012.

* cited by examiner

SAFETY SYSTEM FOR IMAGE FORMING APPARATUS HAVING EXPENDABLE DEVELOPING UNIT

CROSS-REFERENCE TO RELATED APPLICATIONS

This application claims priority under 35 U.S.C. §119(a) from Korean Patent Application No. P2010-125944 filed on Dec. 10, 2010 in the Korean Intellectual Property Office, the disclosure of which is incorporated herein by reference in its entirety.

BACKGROUND OF THE GENERAL INVENTIVE CONCEPT

1. Field of the General Inventive Concept

The present general inventive concept relates to an image forming apparatus including a drawer, which is movably installed at a main body for separation of a developing unit.

2. Description of the Related Art

Image forming apparatuses are used to form an image on a recording medium according to an input image signal. Examples of such an image forming apparatus include a printer, a copier, a facsimile device, and a combination device integrating functions thereof.

The image forming apparatus is provided with a developing unit to develop an electrostatic latent image on a photosensitive body into a visible image through supply of developer to the electrostatic latent image.

Such a developing unit is commonly configured to have a cartridge shape and includes a housing, which has a single process cartridge shape. The housing is equipped with principal parts of the developing unit, such as a photosensitive body, a charging roller, a developing roller, and a supply roller. Also, developer is received in the housing.

In recent years, various kinds of image forming apparatuses have been developed. For example, there is an image forming apparatus including a drawer movably installed at a main body of the image forming apparatus and the developing unit received in the drawer, in order to facilitate replacement of the developing unit when the developer is exhausted.

SUMMARY

It is a feature of the present general inventive concept to provide an image forming apparatus capable of allowing a developing unit to be safely connected or disconnected in response to movement of a drawer.

Additional features and utilities of the present general inventive concept will be set forth in part in the description which follows and, in part, will be obvious from the description, or may be learned by practice of the general inventive concept.

In accordance with one feature of the present general inventive concept, an image forming apparatus includes a main body, a developing unit to receive developer, a drawer movably installed at the main body, the drawer including a tray at which the developing unit is mounted and a cover coupled with the tray while defining one surface of the main body, the cover having a first operation section in which the cover is moved relative to the tray and a second operation section in which the cover is moved together with the tray, an interlocking member to be moved along with the drawer in the first operation section of the cover, and a lift member to be vertically moved according to movement of the interlocking member, wherein the developing unit includes an information storage module to store information of the developing unit, and a first connection terminal provided at one side of the developing unit to transfer the information of the information storage module to an outside of the developing unit, the lift member includes a second connection terminal arranged at one side of the lift member to be vertically moved along with the lift member, and the tray includes a third connection terminal arranged at one side of the tray, the third connection terminal being connected to the first connection terminal of the developing unit received in the tray and being connected to the second connection terminal according to the position of the second connection terminal so as to indirectly connect the first and second connection terminals.

The third connection terminal may include one end arranged at an inner side of the tray to be connected to the first connection terminal of the developing unit received in the tray, and the other end arranged at an outer side of the tray to be selectively connected to the second connection terminal according to the position of the lift member.

The third connection terminal may be formed by bending an elastically deformable metal plate, and the third connection terminal may have one end bent to protrude toward an inner side of the tray.

The image forming apparatus may further include an inner frame provided with a guide hole through which the lift member is mounted to be vertically moved, and the lift member may include a lift guide portion movably supported through the guide hole.

The image forming apparatus may further include an elastic member having one end supported by the lift member and the other end supported by the inner frame, in order to upwardly support the lift member toward the interlocking member.

The interlocking member may include a first guide portion extending downward, the lift member may include a second guide member arranged at a lower side of the interlocking member while protruding upward, the first guide portion may include a first slanted surface which is slanted downward and a first support surface which extends in a movement direction of the interlocking member, and the second guide portion may include a second slanted surface which is slanted upward and a second support surface which extends in a movement direction of the interlocking member.

The image forming apparatus may further include a coupler coupled to the developing unit according to the position of the interlocking member, the coupler having a guide rib which protrudes radially outwards from the coupler, the interlocking member may include a through hole through which the coupler is mounted and a third guide which extends from a portion adjacent to the through hole to guide the guide rib, and the third guide may include a third slanted surface which extends slantingly in a movement direction of the interlocking member and a third support surface which extends to be parallel with the movement direction of the interlocking member.

The image forming apparatus may further include a slot provided at one of the cover and the tray while having an elongated shape in a movement direction of the cover, and a protrusion provided at the other of the cover and the tray to be inserted into the slot, in order to define the first operation section.

The image forming apparatus may further include a first hook extending from a rear surface of the cover and a second hook having one end rotatably coupled to the interlocking member to be engaged with the first hook, thereby moving the interlocking member together with the cover in the first operation section.

The image forming apparatus may further include a guide surface provided at a portion adjacent to the second hook to be slanted downward, and a rotational guide to interact with the guide surface according to movement of the interlocking member so as to release engagement between the first and second hooks through rotation of the second hook.

In accordance with another feature of the present general inventive concept, an image forming apparatus includes a main body, a developing unit to receive developer, a drawer movably installed at the main body, the drawer including a tray at which the developing unit is mounted and a cover coupled with the tray while defining one surface of the main body, the cover having a first operation section in which the cover is moved relative to the tray and a second operation section in which the cover is moved together with the tray, a first connection terminal provided at the developing unit, a second connection terminal provided at the main body, and a third connection terminal provided at the drawer, wherein the first and third connection terminals are connected to each other as the developing unit is received in the tray, and the second and third connection terminals are connected or disconnected according to movement of the cover in the first operation section.

BRIEF DESCRIPTION OF THE DRAWINGS

These and/or other features and of utilities the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
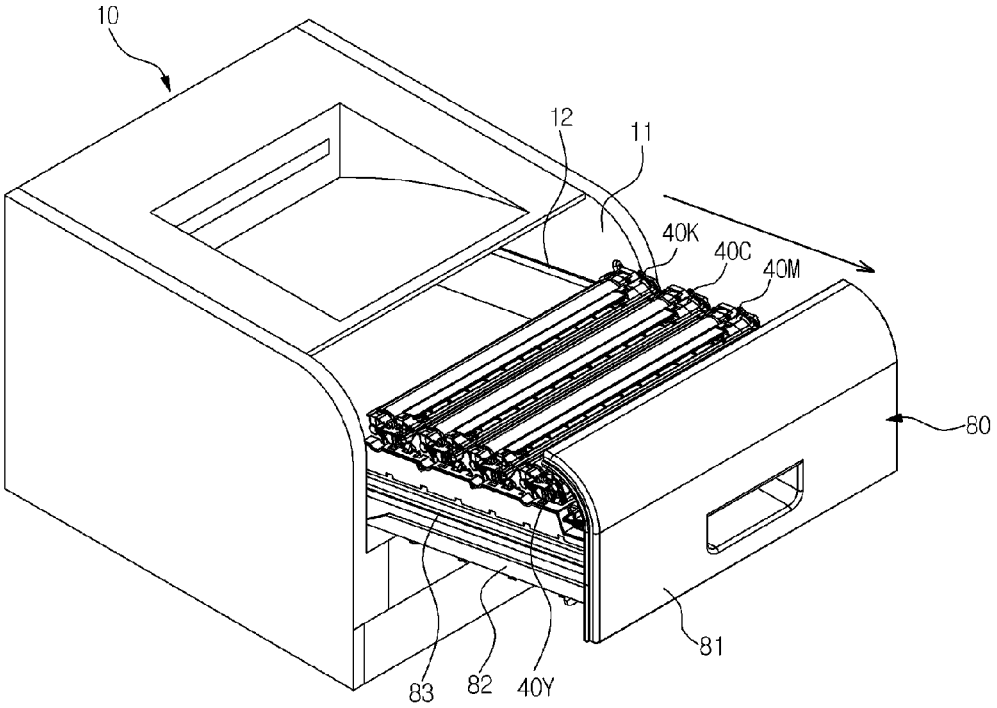
FIG. 1 is a perspective view illustrating an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept while referring to the figures.

Figure 2:
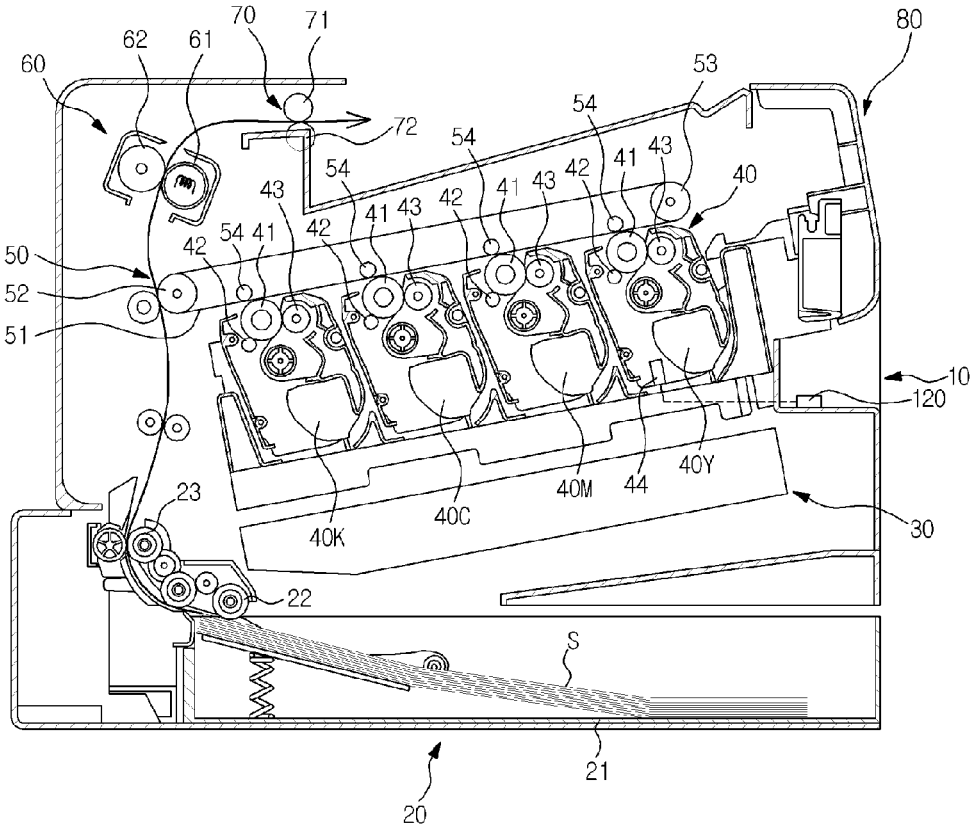
FIG. 2 is a sectional view illustrating the image forming apparatus according to an exemplary embodiment of the present general inventive concept.

As shown in FIGS. 1 and 2, an image forming apparatus according to an exemplary embodiment of the present general inventive concept includes a main body 10, a recording medium supply unit 20, an optical scanning unit 30, a developing unit 40, a transfer unit 50, a fixing unit 60, and a recording medium discharge unit 70.

The main body 10 defines an entire external appearance of the image forming apparatus 1, and also supports a variety of components mounted therein. A portion of the main body 10 may be opened and closed. A user may replace or repair a variety of components or may remove paper jammed in the main body 10, through the opened portion of the main body 10.

The recording medium supply unit 20 serves to supply recording media S to the developing unit 40. The recording medium supply unit 20 includes a cassette 21 detachably mounted at the main body 10. The recording media S are stored in the cassette 21. The recording media S in the cassette 21 are picked up sheet by sheet through a pick-up roller 22 during printing operation. The recording medium S picked-up by the pick-up roller 22 is fed toward the developing unit 40 by feeding rollers 23.

The optical scanning unit 30 irradiates light corresponding to image information, which is input from an external device such as a computer, to each photosensitive body 41, in order to form an electrostatic latent image. When the image forming apparatus 1 is a color image forming apparatus as shown in FIG. 1, the optical scanning unit 30 irradiates light corresponding to each color, for example, yellow Y, magenta M, cyan C, or black B, to the corresponding photosensitive body 41.

The developing unit 40 may be comprised of four developing units 40Y, 40M, 40C, and 40K, which receive different colors of developers, for example, yellow Y, magenta M, cyan C, and black B, respectively. The photosensitive body 41 may be provided at each of the developing units 40Y, 40M, 40C, and 40K. For the convenience of description, "40Y, 40M, 40C, and/or 40K", which are reference numerals for the developing units will be collectively referred to as reference numeral "40" below.

Each of the developing units 40 includes a charging roller 42 to charge the corresponding photosensitive body 41, and a developing roller 43 to supply developer to an electrostatic latent image formed on the photosensitive body 41 so as to form a visible image.

Figure 12:
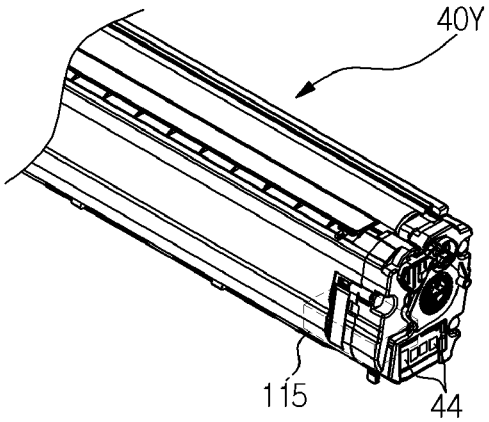
FIG. 12 illustrates a developer unit including an information storage module.

Each of the developing units 40 may include an information storage module 115 (see FIG. 12) to store identification information corresponding to the developing unit 40. The identification information may include, but is not limited to, color information indicating the color of the developer in the developing units 40, life span information indicating a life span of the developing unit 40, and developer information indicating an amount of developer remaining in the developer unit 40. The information storage module 115 is electrically connected to a first connection terminal 44 included with the developing unit 40, as described in greater detail below. Although an exemplary embodiment of FIG. 12 illustrates the information storage module 115 being disposed within a housing of the developing unit 40, the information storage module 115 may also be disposed on an external surface of the developing unit 40.

The transfer unit 50 transfers a developer image formed on each photosensitive body 41 to the recording medium S. The transfer unit 50 includes a transfer belt 51 to travel while coming into contact with the photosensitive bodies 41, a transfer belt driving roller 52 to drive the transfer belt 51, a transfer belt driven roller 53 driven by the transfer belt 51, and four transfer rollers 54 to transfer developer images formed on the respective photosensitive bodies 41 to the recording medium S.

The recording medium S is fed in a state of being attached on the transfer belt 51. In this case, voltage having polarity opposed to that of developer attached on each photosensitive body 41 is applied to the corresponding transfer roller 54, thereby transferring a developer image on the photosensitive body 41 to the recording medium S.

The fixing unit 60 includes a heater 61 and a pressing roller 62. The fixing unit 60 applies heat and pressure to the recording medium S which passes through a nip between the heater 61 and the pressing roller 62, thereby fixing an image, which is not yet fixed on the recording medium S, to the recording medium S.

The recording medium discharge unit 70 discharges the recording medium S emerging from the fixing unit 60 to the outside of the image forming apparatus 1. The recording medium discharge unit 70 includes a discharge roller 71 and a discharge backup roller 72 arranged to face the discharge roller 71.

Meanwhile, the above-mentioned developing unit 40 may be replaced when developer contained in the developing unit 40 is exhausted. To this end, the main body 10 is provided, at one side thereof, with a drawer 80 movably installed in the main body 10. The developing units 40 may be individually received in the drawer 80, and may be separated from one another by the drawer 80. Accordingly, individual developer units 40 may be replaced.

Figure 3:
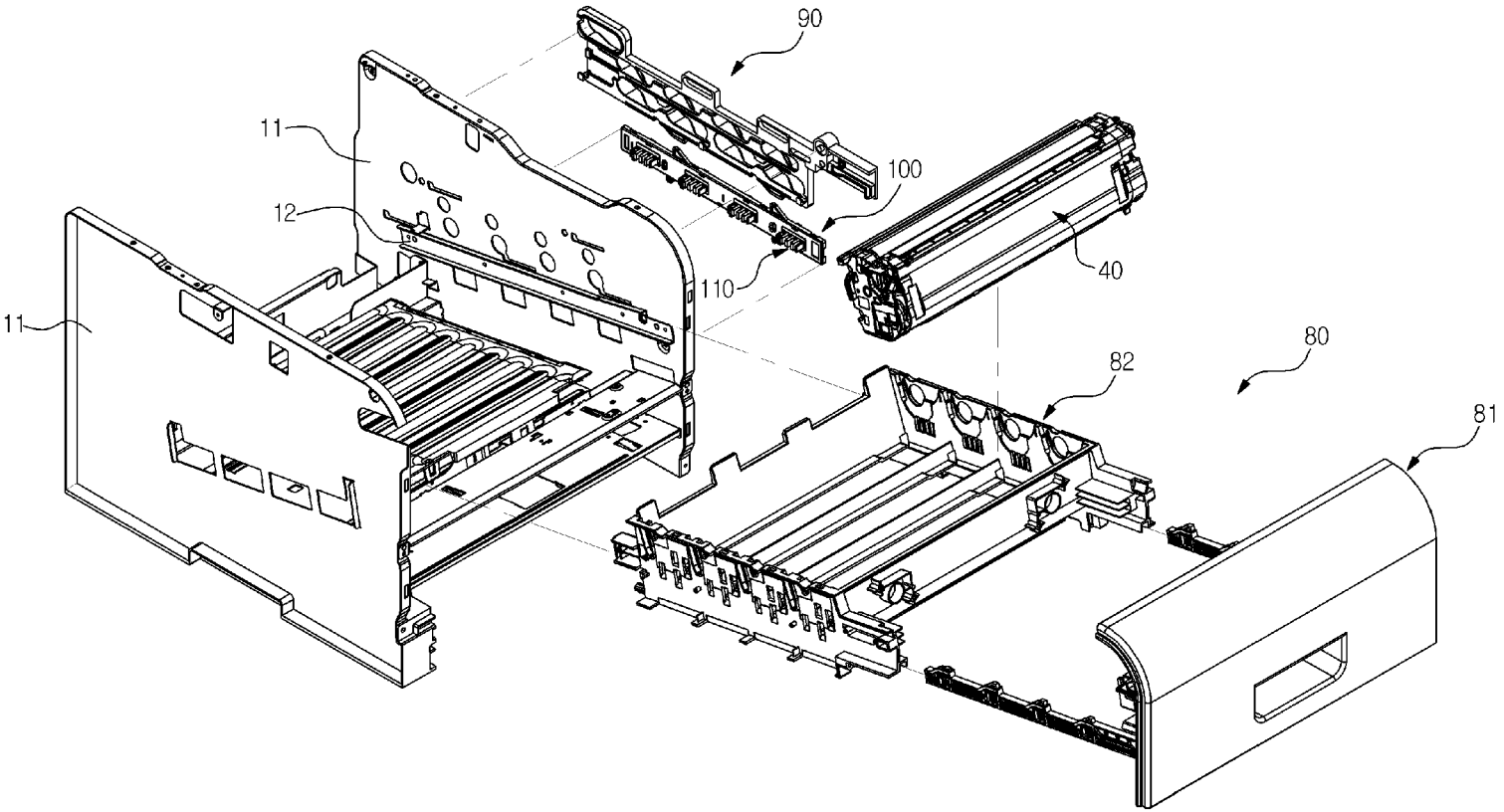
FIG. 3 is an exploded perspective view illustrating an installation state of a drawer applied to the image forming apparatus according to an exemplary embodiment of the present general inventive concept.

Referring to an exemplary embodiment illustrated in FIG. 3, the drawer 80, generally indicated, includes a cover 81 to define one surface of the main body 10, and a tray 82 mounted at a rear surface of the cover 81 to receive the developing units 40. The tray 82 may include individual compartments to receive a respective developing unit 40 such that each developing unit 40 may be separated from one another, and may be individually replaced. The tray 82 is movably mounted between inner frames 11 provided at internal opposite sides of the main body 10 such that the tray 82 may be retracted into and extracted from the main body 10. First rails 12 are mounted at the respective inner frames 11, whereas second rails 83 (see FIG. 1) are respectively installed at opposite sides of the tray 82. The second rails 83 may slidably engage the first rails 12. Thus, the first rails 12 support the second rails, and allow the second rails 83 to be moved with respect to the corresponding first rails 12, thereby allowing the tray 82 to move into and extract from the main body 10. Accordingly, each developing unit 40 received in the tray 82 may be separated and replaced when the tray 82 is extracted from the main body 10 along the first and second rails 12 and 83.

Figure 4:
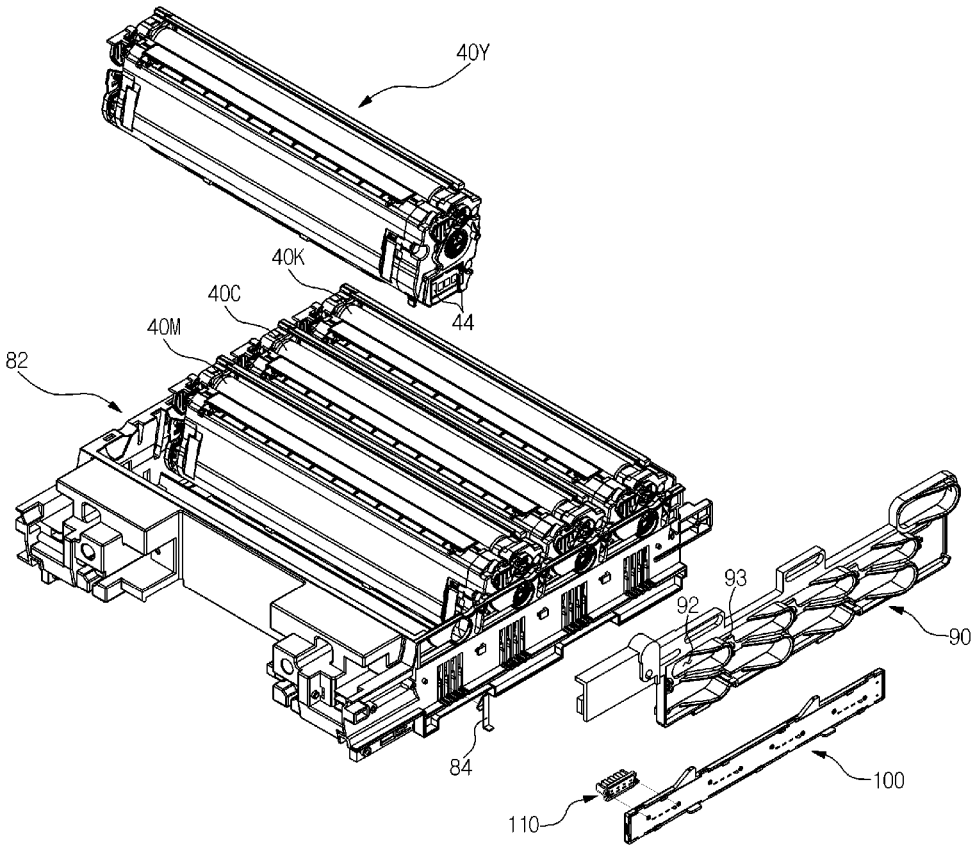
FIG. 4 is an exploded perspective view illustrating a positional relationship of connection terminals to connect a developing unit applied to the image forming apparatus according to an exemplary embodiment of the present general inventive concept.

The developing unit 40 may include one or more terminals to be connected to a corresponding terminal included with the image forming apparatus 1. Referring to an exemplary embodiment illustrate in FIGS. 2-4, each developing unit 40 is provided, at one side thereof, with a first connection terminal 44. The main body 10 is provided with second connection terminals 110, which are in electrical communication with a control unit 120 arranged in the main body 10. A communication interface may be established by connecting the first connection terminal 44 with the connection terminals 110 so that information of the developing unit 40, including the storage information module 115, may be transferred to the control unit 120. Each of the second connection terminals 110 is connected to the control unit 120.

Also, the tray 82 includes a third connection terminal 84 mounted at one side of the tray 82. The third connection terminal 84 contacts the first connection terminal 44 when the developing unit 40 is disposed in the tray 82. Further, the third connection terminal 84 is connected with the second connection terminal 110 according to a position of the tray 82 to indirectly connect the first connection terminal 44 and the second connection terminal 110. That is, the first connection terminal 44 contacts a first portion of the third connection terminal 84, while the second connection terminal 110 contacts a second portion of the third connection terminal 84 such that a common electrically conductive connection is established between each of the first connection terminal 44, the second connection terminal 110, and the third connection terminal 84. Therefore, when the first and second connection terminals 44 and 110 are connected to the third connection terminal 84 as described above, the information stored in the information storage module 115 of the developing unit 40 may be transferred to the control unit 120 in the main body 10 through the first, third, and second connection terminals 44, 84, and 110.

The first connection terminal 44 is provided at one side of each developing unit 40, and has a plurality of terminal pieces. The terminal pieces of the connection terminal may be arranged in parallel with one another along the side of each developing unit 40 (see FIG. 12). The second connection terminals 110 are arranged at the inner frame 11 of the main body 10 (see FIG. 5). The third connection terminal 84 may include, but is not limited to, a metal plate. The third connection terminal 84 may be bent to include one end arranged at an inner side of the tray 82 to be connected with the first connection terminal 44 of each developing unit 40 received in the tray 82, and the other end arranged at an outer side of the tray 82 through the tray 82 to be selectively connected with one of the second connection terminals 110 according to the position of the tray 82.

Further, one end of the third connection terminal 84 may be bent to protrude toward the inner side of the tray 82 so as to be connected with the first connection terminals 44 of the developing units 40, whereas the other end of the third connection terminal 84 extends downward.

Although not shown in the drawings, each second connection terminal 110 may be provided, at a lower surface thereof, with a terminal portion formed by bending the metal plate. The terminal portion protrudes downward so as to be connected to an upper surface of the other end of the third connection terminal 84 according to vertical movement of a lift member 100, which is described in greater detail below.

Accordingly, when one developing unit 40 is received in the tray 82, which is extracted from the main body 10, the first connection terminal 44 is connected to one end of the third connection terminal 84. When the tray 82 is retracted into the main body 10, the other end of the third connection terminal 84 is connected to the second connection terminal 110 mounted in the main body 10 to correspond to the developing unit 40, so that the information of the developing unit 40 may be transferred to the control unit 120 in the main body 10.

In at least one exemplary embodiment, the developing unit 40 and the control unit 120 may be disconnected prior to extraction of the tray 82, and may be connected after the tray 82 is completely retracted into the main body 10. Consequently, the developing unit 40 may be safely connected or disconnected.

To this end, the main body 10 may include a terminal disconnection unit 88 (see FIGS. 6 and 7) to disconnect an electrical connection between the developing unit 40 and the control unit 120.

More specifically, the terminal disconnection unit 88 includes an interlocking member 90 and the lift member 100. In at least one exemplary embodiment, the interlocking member 90 may be coupled to an outer side of the inner frame 11. The interlocking member 90 may be moved within a predetermined range at one side of the tray 82 in response to movement of the cover 81. The lift member 100 is mounted at one inner frame 11, while being arranged at a lower side of the interlocking member 90. Also, the lift member 100 may move upward and downward according to movement of the interlocking member 90, and includes the second connection terminals 110 arranged at one side of the lift member 100. As a result, the second connection terminals 110 are vertically moved along with the lift member 100.

Figure 5:
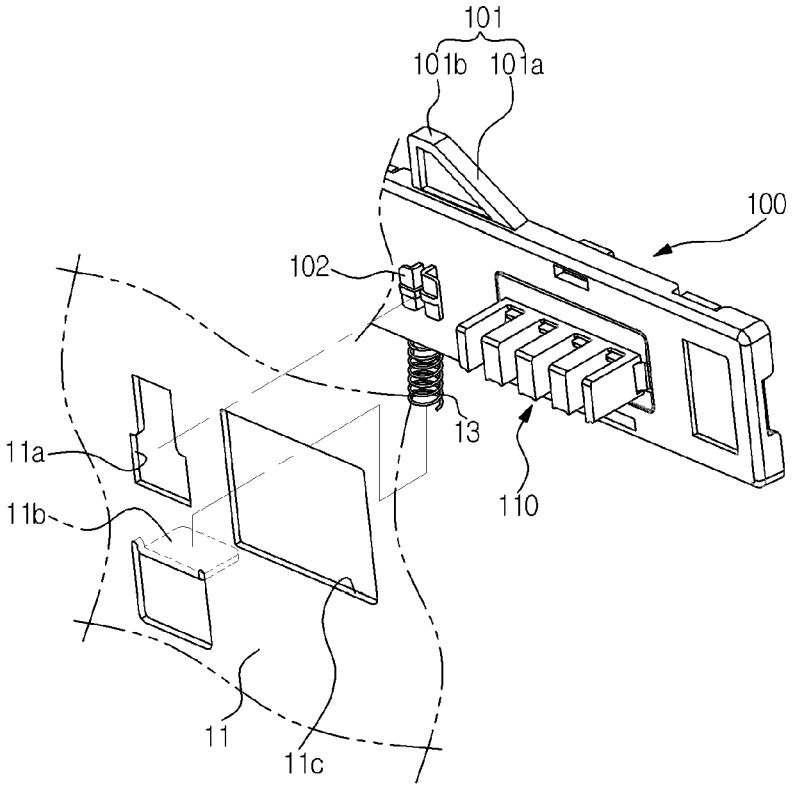
FIG. 5 is a perspective view illustrating a mounting state of a lift member applied to the image forming apparatus according to an exemplary embodiment of the present general inventive concept.

As shown in FIG. 5, the lift member 100 may be mounted at the inner frame 11 as described above to be moved upward and downward. That is, the lift member 100 may be moved in a vertical direction that is perpendicular to the movement of the interlocking member 90. The inner frame 11 is provided with guide holes 11*a*, each guide hole 11*a* having a relatively smaller width in an upper portion thereof than a lower portion thereof. The lift member 100 is formed with lift guide portions 102, which are movably fitted in the respective upper portions of the corresponding guide holes 11*a*. Further, the lift member 100 is elastically biased upward by each elastic member 13 so that an upper end of the elastic member 13 is supported by a lower end of the lift member 100 and a lower end of the elastic member 13 is supported by corresponding protrusion portion 11*b* protruding from the inner frame 11.

The second connection terminals 110 protrude from the lift member 100 to be arranged above the other end of the third connection terminal 84. The inner frame 11 is provided with connection holes 11*c* to receive respective exposed ends of the second connection terminals 110.

The drawer 80 has a first operation section in which the cover 81 vertically moves the lift member 100 while being moved together with the interlocking member 90, and a second operation section in which the cover 81 allows the tray 82 to be extracted from or retracted into the main body 10 while being moved together with the tray 82. In at least one exemplary embodiment, an operation unit may include the cover 81, the drawer 80 and a coupling unit 86 (see FIGS. 6-8), described further below, to control the first and second operation sections.

Figure 6:
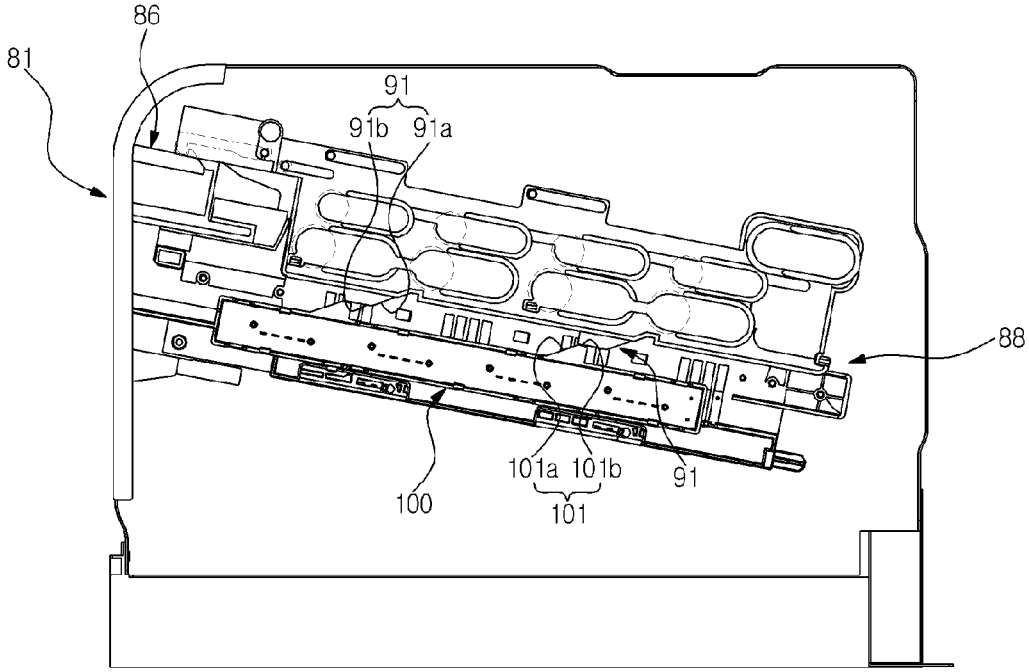
FIGS. 6 and 7 are views schematically illustrating operation between an interlocking member and a lift member applied to the image forming apparatus according to an exemplary embodiment of the present general inventive concept.

As shown in FIG. 6, the interlocking member 90 is provided with first guide portions 91. The lift member 100 is provided with second guide portions 101 which interact with the corresponding first guide portions 91, respectively, as the interlocking member 90 is moved with respect to the lift member 100. That is, the interlocking member 90 is coupled to the cover 81 via a coupling unit 86, which is described in greater detail below. Accordingly, as the cover 81 is moved away from the main body 10, the first guide portions 91 of the interlocking member 90 are guided along the second guide portions of the lift member 100. In accordance with such a configuration, the lift member 100 may be vertically moved via the elastic member 13 in response to movement of the interlocking member 90 in the first operation section.

Each first guide portion 91 includes a first slanted surface 91*a* which downwardly protrudes at an angle from a lower surface of the interlocking member 90, and a first support surface 91*b* which extends in the moving direction of the interlocking member 90 from the first slanted surface 91*a*. Similarly, each second guide portion 101 includes a second slanted surface 101*a* which upwardly protrudes at an angle from an upper surface of the lift member 100, and a second support surface 101*b* which extends in the moving direction of the interlocking member 90 from the second slanted surface 101*a*.

Figure 7:
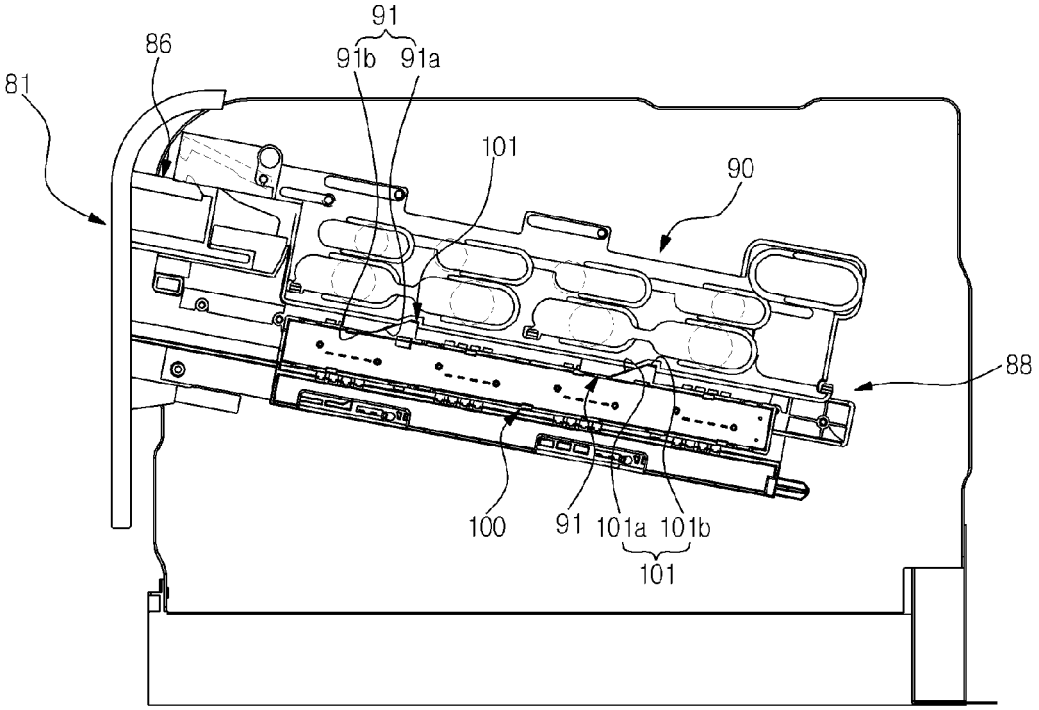

Accordingly, when the interlocking member 90 is moved according to separation of the cover 81 from the main body 10 in the first operation section, the lift member 100, which has been maintained in a state moved downward by being downwardly pressed through the second support surfaces 101*b* by the corresponding first support surfaces 91*b* of the interlocking member 90, is upwardly moved by resilience of the elastic members 13, as shown in FIG. 7, as the first slanted surface 91*a* and the second slanted surface 101*a* engage each other. Consequently, the connection of the second and third connection terminals 110 and 84 is released.

Figure 8:
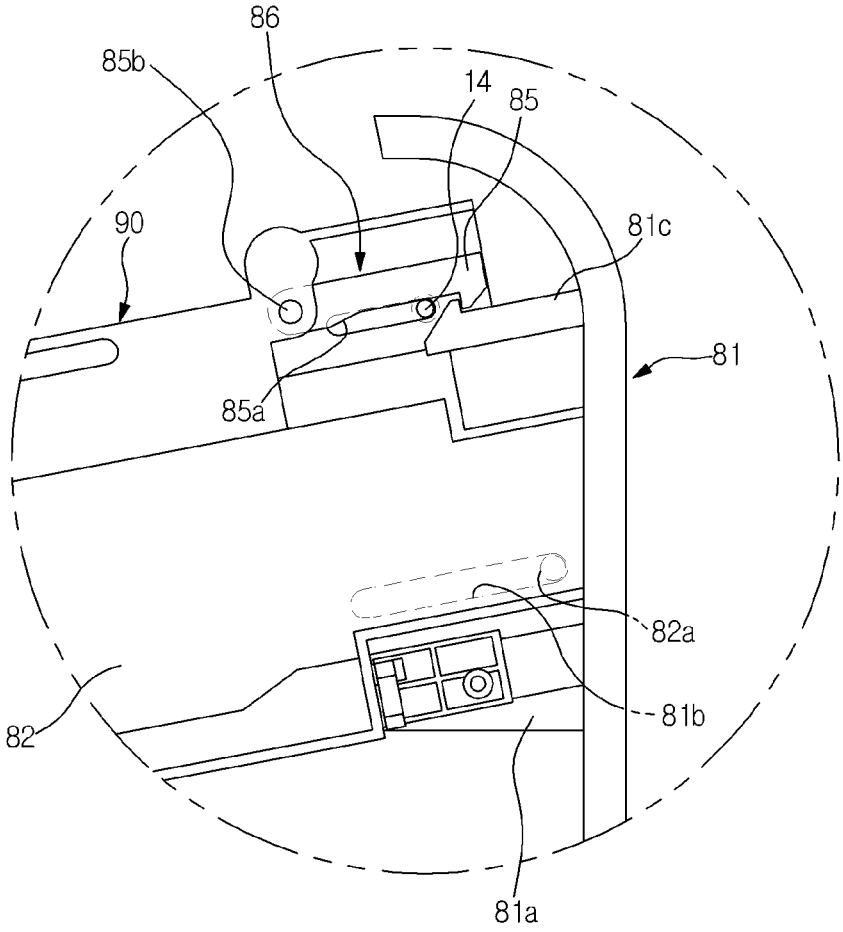
FIGS. 8 and 9 are views schematically illustrating operation between a cover and a tray in the drawer applied to the image forming apparatus according to an exemplary embodiment of the present general inventive concept.
Figure 9:
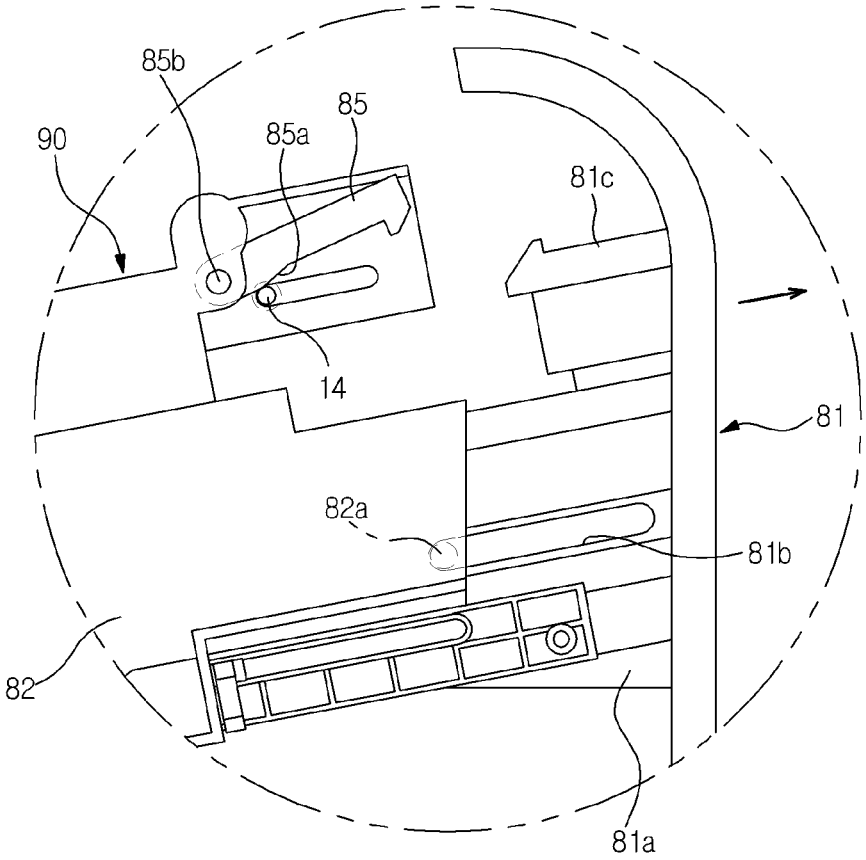

As shown in FIGS. 8 and 9, a coupling unit 86 selectively couples the cover 81 and the interlocking member 90. In at least one exemplary embodiment, the coupling unit is provided by a hooking unit including a plurality of hooks. It is appreciated, however, that the coupling unit is not limited to a hooking unit. More specifically, the cover 81 is provided with a first hook 81*c* extending from a rear surface of the cover 81, whereas the interlocking member 90 is provided with a second hook 85 engaged with the first hook 81*c*, in order to move the interlocking member 90 together with the cover 81 in the first operation section.

The second hook 85 has one end rotatably that rotates about a hinge 85*b* formed on the interlocking member 90. The second hook 85 is provided, at a portion adjacent to the end thereof, with a guide surface 85*a* which is slanted downward. The main body 10 includes a rotational guide 14 to interact with the guide surface 85*a* according to movement of the interlocking member 90 so as to rotate the second hook 85. In accordance with such a configuration, the interlocking member 90 is moved along with the cover 81 when the cover 81 is moved in a state in which the second hook 85 is engaged with the first hook 81*c*. Subsequently, the second hook 85 is rotated when the guide surface 85*a* of the second hook 85 contacts the rotational guide 14 according to movement of the interlocking member 90. The engagement between the first and second hooks 81*c* and 85 is then released according to rotation of the second hook 85. In this state, since the interlocking member 90 cannot receive force from the cover 81, movement of the interlocking member 90 is ceased.

In order for the tray 82 to be extracted from the main body 10 while moving along with the cover 81 in the second operation section, guide frames 81*a* extend from the rear surface of the cover 81, and each guide frame 81*a* is formed with a guide slot 81*b* extending to be parallel with the moving direction of the interlocking member 90. Also, a protrusion 82*a* protruding from the tray 82 is arranged in each guide slot 81*b*. When the cover 81 is moved in the first operation section, the protrusion 82*a* is moved between opposite ends of the corresponding guide slot 81*b*. Thus, the cover 81 may be moved independently of the tray 82.

Further, each protrusion 82*a* is supported by one end of the corresponding guide slot 81*b* when the cover 81 begins to enter the second operation section after exiting the first operation section. In this case, the tray 82 cannot receive force from the cover 81. In this state, when the cover 81 is further moved to be apart from the main body 10, the tray 82 is moved along with the cover 81 to be extracted from the main body 10.

Figure 10:
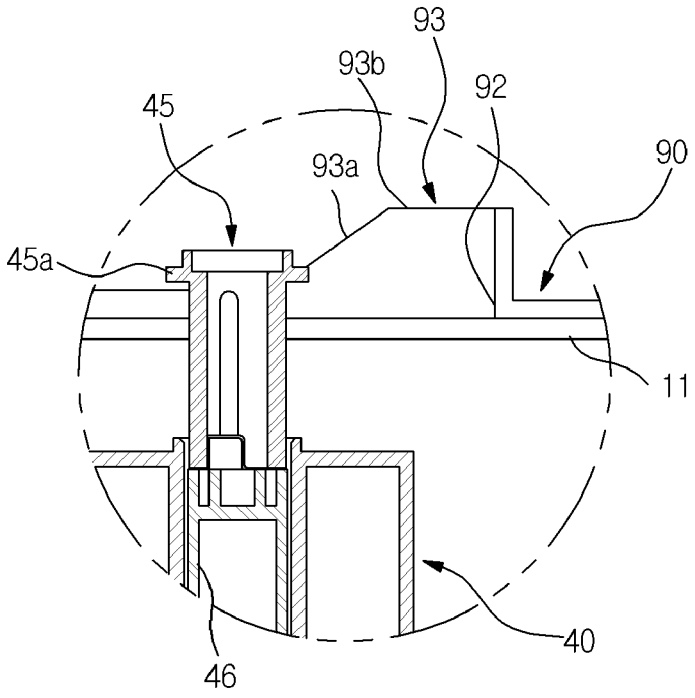
FIGS. 10 and 11 are views schematically illustrating operation of a coupler applied to the image forming apparatus according to an exemplary embodiment of the present general inventive concept.
Figure 11:
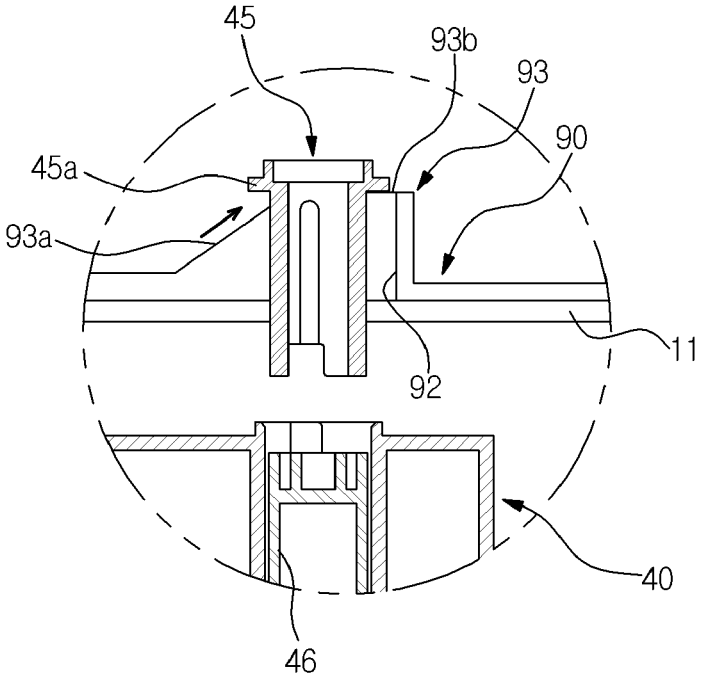

As shown in FIGS. 10 and 11, a coupler 45 is movably mounted at the interlocking member 90 to be coupled to each developing unit 40 in order to operate the developing unit 40.

The coupler 45 is coupled to a roller 46 arranged at the corresponding developing unit 40 or coupling between the coupler 45 and the roller 46 is released, according to movement of the interlocking member 90.

To this end, the interlocking member 90 is provided with a through hole 92 through which each coupler 45 is mounted. A third guide 93 to guide movement of the coupler 45 is formed at a portion adjacent to the corresponding through hole 92.

Each third guide 93 includes a third slanted surface 93*a* which extends laterally at an angle from the interlocking member 90, and a third support surface 93*b* which extends from the third slanted surface 93*a* in the movement direction of the interlocking member 90. Each coupler 45 is formed with a support rib 45*a* extending radially outwards from the coupler 45 and is guided by the corresponding third slanted surface 93*a* and third support surface 93*b*.

Thus, the coupler 45 is coupled to the corresponding developing unit 40, or a coupling between the coupler 45 and the developing unit 40 is released, in response to the lateral movement of the coupler 45 along the interlocking member 90 during movement of the interlocking member 90 in the first operation section. In at least one exemplary embodiment, the coupler 45 is coupled to the developing unit 40 in response to retracting the drawer 80 into the main body 10, whereas the coupling between the coupler 45 and the developing unit 40 is released in response to extracting the drawer 80 from the main body 10.

As is apparent from the above description, in accordance with features of the present general inventive concept, since the tray 82 is not moved during movement of the drawer 80 in the first operation section, the developing unit 40 may be safely connected or disconnected in this state. Further, the position of the tray 82 and the cover 81 may control an electrical connection between one or more developing units 40 and the control unit 120 of the image forming apparatus 1 to communicate information of the developing unit 40.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a main body;

a developing unit to receive developer;

a drawer movably installed at the main body, the drawer comprising a tray to support the developing unit and a cover coupled with the tray to define one surface of the main body, the cover having a first operation section to move the cover relative to the tray and a second operation section to move the cover together with the tray;

an interlocking member to be moved along with the drawer in the first operation section of the cover; and a lift member to be vertically moved in response to a movement of the interlocking member, wherein:

the developing unit comprises an information storage module to store information of the developing unit, and a first connection terminal provided at one side of the developing unit to transfer the information of the information storage module to an outside of the developing unit;

the lift member comprises a second connection terminal arranged at one side of the lift member to be vertically moved along with the lift member; and the tray comprises a third connection terminal arranged at one side of the tray, the third connection terminal being connected to the first connection terminal of the developing unit received in the tray and being connected to the second connection terminal in response to a position of the second connection terminal so as to indirectly connect the first and second connection terminals.

2. The image forming apparatus according to claim 1, wherein the third connection terminal comprises one end arranged at an inner side of the tray to be connected to the first connection terminal of the developing unit received in the tray, and the other end arranged at an outer side of the tray to be selectively connected to the second connection terminal according to a position of the lift member.

3. The image forming apparatus according to claim 1, wherein:

the third connection terminal is formed by bending an elastically deformable metal plate; and the third connection terminal has one end bent to protrude toward an inner side of the tray.

4. The image forming apparatus according to claim 1, further comprising:

an inner frame provided with a guide hole through which the lift member is mounted to be vertically moved, wherein the lift member comprises a lift guide portion movably supported through the guide hole.

5. The image forming apparatus according to claim 4, further comprising:

an elastic member having one end supported by the lift member and the other end supported by the inner frame, in order to upwardly support the lift member toward the interlocking member.

6. The image forming apparatus according to claim 1, wherein:

the interlocking member comprises a first guide portion extending downward;

the lift member comprises a second guide member arranged at a lower side of the interlocking member while protruding upward;

the first guide portion comprises a first slanted surface which is slanted downward and a first support surface which extends in a movement direction of the interlocking member; and the second guide portion comprises a second slanted surface which is slanted upward and a second support surface which extends in a movement direction of the interlocking member.

7. The image forming apparatus according to claim 1, further comprising:

a coupler coupled to the developing unit according to a position of the interlocking member, the coupler having a guide rib which protrudes radially outwards from the coupler, wherein the interlocking member comprises a through hole through which the coupler is mounted, and a third guide which extends from a portion adjacent to the through hole to guide the guide rib, and wherein the third guide comprises a slanted surface which extends slantingly in a movement direction of the interlocking member, and a support surface which extends to be parallel with the movement direction of the interlocking member.

8. The image forming apparatus according to claim 1, further comprising:

a slot provided at one of the cover and the tray and having an elongated shape in a movement direction of the cover, and a protrusion provided at the other of the cover and the tray and to be inserted into the slot, in order to define the first operation section.

9. The image forming apparatus according to claim 1, further comprising:

a first hook extending from a rear surface of the cover; and a second hook having one end rotatably coupled to the interlocking member to be engaged with the first hook, thereby moving the interlocking member together with the cover in the first operation section.

10. The image forming apparatus according to claim 9, further comprising:

a guide surface provided at a portion adjacent to the second hook to be slanted downward; and a rotational guide to interact with the guide surface according to the movement of the interlocking member so as to release engagement between the first and second hooks through rotation of the second hook.

11. An image forming apparatus comprising:

a main body;

a developing unit to receive developer;

a drawer movably installed at the main body, the drawer comprising a tray to support the developing unit and a cover coupled with the tray while defining one surface of the main body, the cover having a first operation section to move the cover relative to the tray and a second operation section to move the cover together with the tray;

a first connection terminal provided at the developing unit;

a second connection terminal provided at the main body; and a third connection terminal provided at the drawer, wherein the first and third connection terminals are connected to each other as the developing unit is received in the tray, and wherein the second and third connection terminals are at least one of connected and disconnected in response to movement of the cover in the first operation section.

12. The image forming apparatus according to claim 11, further comprising:

an information storage module to store information of the developing unit, wherein the first connection terminal is connected to the third connection terminal, to allow the information of the information storage module to be transferred to a control unit of the main body via the third and second connection terminals.

13. The image forming apparatus according to claim 11, further comprising:

an interlocking member to be moved along with the cover in the first operation section; and a lift member to be vertically moved according to movement of the interlocking member, wherein the second connection terminal is arranged at the lift member to be vertically moved along with the lift member, in order to be connected with the third connection terminal.

14. The image forming apparatus according to claim 13, wherein:

the interlocking member comprises a first guide portion extending downward;

the lift member comprises a second guide member arranged at a lower side of the interlocking member while protruding upward;

the first guide portion comprises a first slanted surface which is slanted downward and a first support surface which extends in a movement direction of the interlocking member; and the second guide portion comprises a second slanted surface which is slanted upward and a second support surface which extends in the movement direction of the interlocking member.

15. The image forming apparatus according to claim 14, further comprising:

a coupler selectively coupled to the developing unit according to a position of the interlocking member, the coupler having a guide rib which protrudes radially outwards from the coupler, wherein the interlocking member comprises a through hole through which the coupler is mounted, and a third guide which extends from a portion adjacent to the through hole to guide the guide rib, and wherein the third guide comprises a third slanted surface which extends slantingly in a the movement direction of the interlocking member, and a third support surface which extends to be parallel with the movement direction of the interlocking member.

16. An image forming apparatus, comprising:

a main body including an electrical terminal;

a cover that moves between an open position and a closed position with respect to the main body;

a tray supported by the main body and coupled to the cover to move in response to a movement of the cover, the tray including an electrically conductive plate and at least one compartment to support a developing unit having a connecting terminal that contacts the plate when the developing unit is disposed in the at least one compartment; and a coupling unit operable in an engaged state and a disengaged state based on the movement of the cover, wherein the coupling unit couples together the cover and the tray while operating in the engaged state such that the tray moves together with the cover to disconnect the plate from the electrical terminal, and the coupling unit releases the cover from the tray while operating in the disengaged state such that the cover moves independently from the tray, and wherein an electrically conductive path between the electrical terminal, the plate, and the connecting terminal is based on a movement of the tray.

17. The image forming apparatus of claim 16, further comprising a terminal disconnection unit operable in response to the movement of the tray to disconnect the electrical terminal and the plate.

18. The image forming apparatus of claim 17, wherein the terminal disconnection unit comprises:

an interlocking member that moves in response to the movement of the cover in a first operation section; and a lift member having the electrical terminal formed thereon and being elastically coupled to the main body to move vertically based on contact of the interlocking member, wherein the lift member is forced downward and the electrical terminal contacts the plate when the cover exists in the closed position, and the lift member is forced vertically upward in response to contacting the interlocking member to disconnect the electrical terminal from the plate when the cover exists in the open position.

19. An image forming apparatus, comprising:

an operation unit selectively operable in a first operation mode and a second operation mode, the operation unit including drawer, a cover mounted to the drawer, and a coupling unit mounted to the cover to select the first and second operation modes;

a tray supported by the drawer and including an electrically conductive plate to contact an electrical terminal formed on a developing unit disposed in the tray; and a terminal disconnection unit coupled to the operation unit and including a connecting terminal that contacts the electrically conductive plate during the first operation mode and that is separated from the electrically conductive plate during the second operation mode, wherein the cover is moveable between a closed position, such that the coupling unit selects the first operation mode, and an open position such that coupling unit selects the second operation mode.

20. The image forming apparatus of claim 19, wherein the terminal disconnection unit comprises:

an interlocking member selectively coupled to the coupling unit and moveable between a first position set by the first operation mode and a second position set by the second operation mode; and a lifting member elastically biased in a vertical direction perpendicular to a movement of the interlocking member and including a connection terminal contacting the electrically conductive plate in response to the first position of the interlocking unit and separated from the electrically conductive plate in response to the second position of the interlocking unit.

21. The image forming apparatus of claim 20, wherein the interlocking member moves a predetermined distance between the first position and the second position based on an operation mode set by the cover, and wherein the interlocking member exerts a pressing force on the lifting member downward such that the electrically conductive plate contacts the connecting terminal in response to the first position and releases the pressing force such that the electrically conductive plate is separated from the connecting terminal in response to the second position.

22. The image forming apparatus of claim 21, wherein the cover, the drawer and the interlocking member move in tandem with each other in response to the first operating mode, and the cover and drawer move separately from the interconnecting member in response to the second operating mode.

23. The image forming apparatus of claim 22, wherein the electrically conductive plate of the tray is separated from the connecting terminal of the lifting member to extract the tray in response the second operating mode set by moving the cover to the open position.

24. A safety system for an image forming apparatus having an expendable developing unit, comprising:

a main body of the image forming apparatus, the main body having a first terminal;

a receptacle having a second terminal and configured to move in one dimension and to receive the expendable developing unit, the expendable developing unit having a third terminal; and a mechanical linkage coupled to the receptacle and configured to move in two dimensions and to disconnect the second terminal from the first terminal during a first phase of opening a cover of the image forming apparatus and to move in the one dimension during a second phase of opening the cover, wherein an electrically conductive path through the first terminal, the second terminal, and the third terminal is based on a movement of the receptacle.

* * * * *